US007712725B2

(12) United States Patent
Jang

(10) Patent No.: US 7,712,725 B2
(45) Date of Patent: May 11, 2010

(54) DRAIN VALVE ASSEMBLY

(75) Inventor: Sam Jang, Chicago, IL (US)

(73) Assignee: Richco Inc., Morton Grove, IL (US)

( * ) Notice: Subject to any disclaimer, the term of this patent is extended or adjusted under 35 U.S.C. 154(b) by 82 days.

(21) Appl. No.: 11/665,412

(22) PCT Filed: Oct. 13, 2005

(86) PCT No.: PCT/US2005/038246

§ 371 (c)(1),
(2), (4) Date: Apr. 14, 2007

(87) PCT Pub. No.: WO2006/047444

PCT Pub. Date: May 4, 2006

(65) Prior Publication Data

US 2007/0290159 A1 Dec. 20, 2007

Related U.S. Application Data

(60) Provisional application No. 60/622,465, filed on Oct. 26, 2004.

(51) Int. Cl.
*F16K 31/00* (2006.01)

(52) U.S. Cl. ..... 251/340; 251/144; 251/344; 251/341; 251/148

(58) Field of Classification Search ..... 251/341, 251/343, 344, 340, 142, 149.8, 149.9, 149, 251/149.1, 319, 110, 114, 115, 111, 349, 251/352, 353, 144, 148; 137/800; 222/153.14, 222/522, 523, 525, 563
See application file for complete search history.

(56) References Cited

U.S. PATENT DOCUMENTS

| | | | | | |
|---|---|---|---|---|---|
| 3,806,085 | A | * | 4/1974 | Codo | 251/144 |
| 3,856,262 | A | | 12/1974 | Jordan | |
| 3,985,332 | A | | 10/1976 | Walker | |
| 4,025,048 | A | * | 5/1977 | Tibbitts | 251/144 |
| 4,529,167 | A | * | 7/1985 | Harrison et al. | 251/144 |
| 4,679,618 | A | * | 7/1987 | Farkas | 165/71 |
| 4,745,894 | A | * | 5/1988 | Laipply et al. | 123/196 R |
| 4,807,847 | A | | 2/1989 | Martz | |
| 5,096,158 | A | | 3/1992 | Burdick et al. | |
| 5,203,831 | A | * | 4/1993 | Lind et al. | 137/1 |
| 5,246,202 | A | | 9/1993 | Beamer | |
| 5,305,984 | A | * | 4/1994 | Chen | 251/149.1 |
| 5,312,363 | A | * | 5/1994 | Ryan et al. | 604/167.04 |
| 5,407,177 | A | | 4/1995 | Lombardo | |

(Continued)

*Primary Examiner*—John K Fristoe, Jr.
*Assistant Examiner*—Marina Tietjen
(74) *Attorney, Agent, or Firm*—Martin Faier; James M. Faier; Faier & Faier P.C.

(57) ABSTRACT

A drain valve assembly having a stem which can be inserted into a crankcase or other fluid reservoir, wherein the stem is connected to a housing which encloses a sealing barrel movably secured and sealed in the connected stem and housing, and wherein the sealing barrel can be manipulated in a single direction from the exterior of the assembly to open or close a fluid passage through the assembly. An end cap may also be provided tethered to the housing for sealing off the fluid passage. Selected movement of the sealing barrel in the connected stem and housing may also be used to control the volume and flow of fluid through the fluid passage.

10 Claims, 2 Drawing Sheets

U.S. PATENT DOCUMENTS

| | | | | |
|---|---|---|---|---|
| 5,411,115 | A | 5/1995 | Shropshire | |
| 5,433,410 | A * | 7/1995 | Foltz | 251/100 |
| 5,533,554 | A | 7/1996 | Young | |
| 5,609,195 | A | 3/1997 | Stricklin et al. | |
| 5,908,086 | A | 6/1999 | Conklin et al. | |
| 6,113,072 | A | 9/2000 | Wickett | |
| 6,609,699 | B2 | 8/2003 | Chen | |
| 6,719,273 | B1 * | 4/2004 | Yang | 251/341 |
| 6,742,681 | B1 * | 6/2004 | Yang | 222/509 |
| 7,114,703 | B2 * | 10/2006 | Ciesielka | 251/344 |
| 7,341,240 | B2 * | 3/2008 | Ciesielka | 251/345 |
| 2002/0129858 | A1 | 9/2002 | Meyer et al. | |
| 2006/0163518 | A1 * | 7/2006 | Ciesielka | 251/345 |

* cited by examiner

DRAIN VALVE ASSEMBLY

Priority in this application is based upon a Provisional Patent Application filed Oct. 26, 2004, identified as U.S. Ser. No. 60/622,465.

This invention related to a drain valve assembly for withdrawing fluid from a reservoir and is particularly concerned with draining fluid from a crankcase or the like, particularly in small engines like those found in lawn and garden tractors, small gasoline appliances, and the like.

BACKGROUND AND SUMMARY OF THE INVENTION

Draining the crankcase of a small engine is frequently done by a home owner and not by a trained mechanic, and that process is often a messy job. Conventionally, this job is done by unscrewing a draincock or plug at the lowest point of the crankcase or fluid reservoir. The unscrewing of the drain plug is frequently associated with a spill of the oil or other liquid. Oftentimes, the drain will begin to leak before the plug is fully opened, and turning it one way or the other will cause the draining to cease or create a steadier uncontrolled flow. Obviously, uncontrolled spills are not only messy, but are adverse to the environment and sometimes dangerous, as the fluid tends to soak into whatever surface it drains to, is often difficult to clear or clean and is some times combustible.

In the past, many inventors have sought to deal with these problem by designing special drain valves. Examples of such devices include those structures found in:

- Chen U.S. Pat. No. 6,609,699, OIL DRAIN VALVE;
- Wickett U.S. Pat. No. 6,113,072, ACCESS PORT OR DRAIN PLUG WITH VALVE FOR LIQUID CONTAINERS;
- Conklin et al U.S. Pat. No. 5,908,086, QUICK DRAIN CRANKCASE DRAIN PLUG;
- Shropshire et al U.S. Pat. No. 5,411,115, OIL DRAIN PLUG;
- Lombardo U.S. Pat. No. 5,407,117, OIL VALVE DEVICES FOR REMOVING USED OIL FROM DRAIN PANS OF VEHICLES;
- Burdick et al U.S. Pat. No. 5,096,158, OIL DRAIN VALVE ASSEMBLY;
- Martz U.S. Pat. No. 4,807,847. VALVED OIL PAN PLUG;

These designs usually involved critical trigger arrangements for opening and closing the flow of fluid or devices such as balls or cams which could interfere with the smooth flow of fluid (particularly where the fluid contains solids or is pasty) or twisting of the drain plug upon weak parts of the assembly or diverting the flow from a straight gravity flow which interfered with the draining of semi-viscous fluids, like some spent heavy oils. All of these systems are believed to require relatively difficult designs or not suitable or versatile enough for most types of simple drain application or involve risk of leaks or handling of messy parts or dangerous materials to accomplish the fluid draining job.

In the present invention, the drain valve assembly has a stem which may be threaded or otherwise inserted into the housing of an oil pan, preferably at the lowest point thereof, for smooth gravity flow from the fluid reservoir. This stem receives one end of a novel sealing barrel seated therein and extending downwardly therefrom, and arranged over the other end of the barrel is an outside housing. In the stem and housing there is an o-ring which seals the barrel into the stem and outside housing. At the free end of the outside housing, there may be a safety end cap tethered to the housing and free to be moved on to and off the free end of the barrel. Extending from the barrel in the direction of flow are integral tabs which may be pinched together to free the barrel for vertical movement so that the barrel may be pulled downwardly to open a channel through the barrel and allow the fluid to flow from the fluid reservoir, or when opened, to be lifted for closing the channel. With this arrangement, the valve or barrel is opened or closed merely by moving it upwardly or downwardly, without any twisting or switching of a valve relatively to the direction of flow, and further, only the outside of the barrel is manipulated, so that the user does not come into contact with any surface touching the fluid. The barrel may be rotated horizontally so the it is accessible from any degree on its circumference.

OBJECTS AND ADVANTAGES OF THE INVENTION

It is the object of the present invention to provide a novel drain valve assembly of the character recited.

Another object is to provide a novel sealing barrel for a drain valve assembly.

Another object is to provide a novel drain valve which can be opened or close by moving a sealing barrel only in the direction of flow.

Another object is to provide a novel drain valve which can be opened and closed from the exterior of the valve assembly without contacting parts of the assembly coming in contact with the fluid being drained.

Another object is to provide novel opening-closing mechanism for a drain valve assembly which can be manipulated from members formed integrally with a drain valve sealing barrel.

Another object is to provide a drain valve assembly which can be fabricated from a few parts.

Another object is to provide a drain valve barrel which can be horizontally rotated to any degree position in the circumference of a circle so that its opening tabs may be manipulated irrespective of its orientation in the stem and housing.

Another object is to provide a drain valve assembly which is easy and inexpensive to fabricate and simple and efficient to use.

These and other objects and advantages of the invention will become more apparent as this description proceeds, taken in conjunction with the appended drawings and claims.

DESCRIPTION OF A PREFERRED EMBODIMENT

Figure 2:
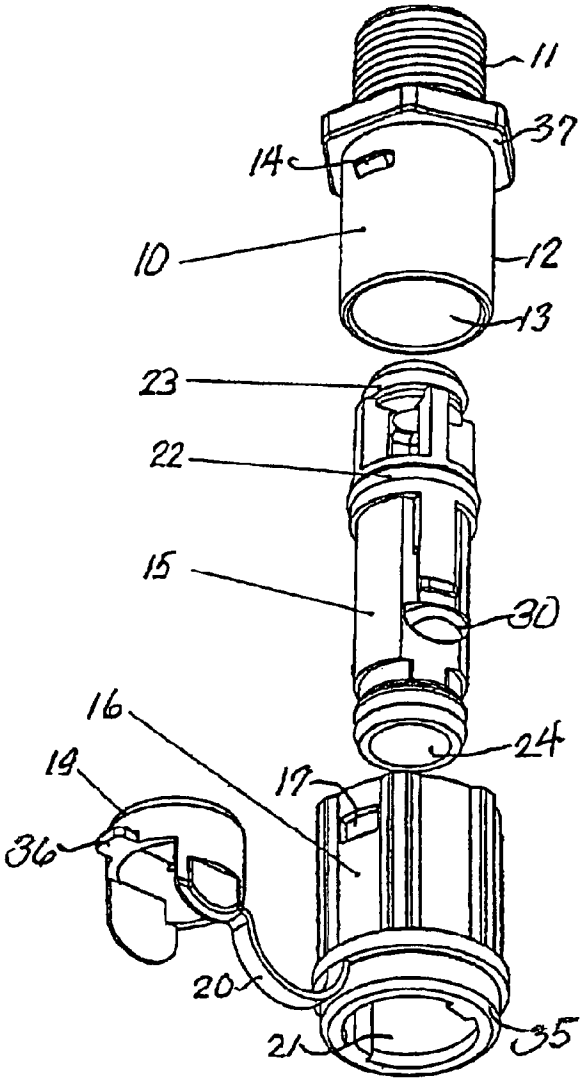
FIG. 2 is an isometric view of the drain valve assembly shown in FIG. 1, with some of the individual parts of the assembly shown exploded from one another.
Figure 1:
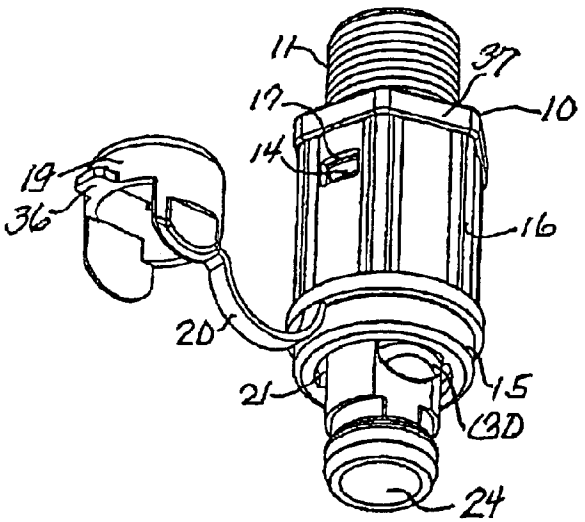
FIG. 1 is a perspective view of a drain valve assembly embodying the invention.

With reference to the accompanying drawings, a typical drain valve assembly embodying the present invention comprises a stem 10, which may have a threaded end 11 adapted for insertion in the crankcase of an engine (not shown). The other end of the stem 10 remote from the threaded end 11 comprises a sleeve 12, and this entire stem has an axial passage 13 which permits the flow of fluid therethrough. This sleeve 12 has on opposed exterior sides thereof at least two ribs 14 extending therefrom. One end of a sealing barrel 15 is positioned in the sleeve 12, and the other end of the sealing barrel 15 extends through an outside housing 16. This outside housing 16 has an interior diameter sized to overlay the sleeve 12 of the stem 10, and has apertures 17 which engage the ribs 14 of the sleeve to hold the housing 16 and stem together overlaying the sealing barrel 15. At the end 18 of the barrel 15 remote from the stem 15 a safety end cap 19 tethered to the housing by a strap 20 is adapted to close a axial aperture 24 in the barrel 15 which is arranged in line to the axial passage 13 in the stem 10.

O-rings 22 and 23 are provided on the sealing barrel 15 to seal the barrel in the stem 10 and housing 16 and to prevent fluid flow or leakage at points other than through the drain valve in the matter hereinafter described. Aperture 24 in the barrel 15 is in flow communication with the passage 13 and the channel 21 when the valve is open as hereafter described.

Figure 3:
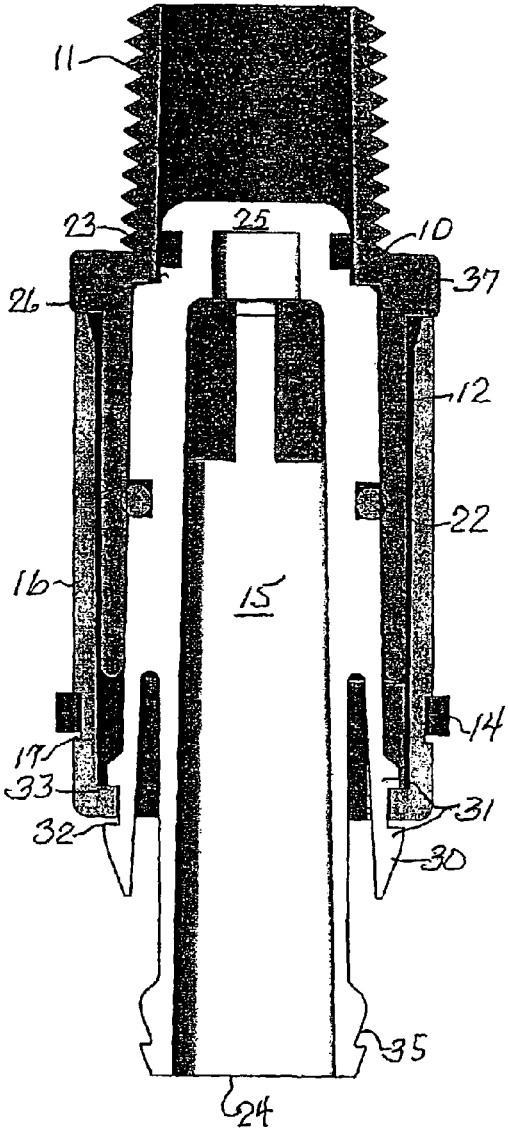
FIG. 3 is a view showing the sealing barrel of the drain valve assembly arranged against the stem in normally closed position (the safety end cap and tether are not shown).
Figure 4:
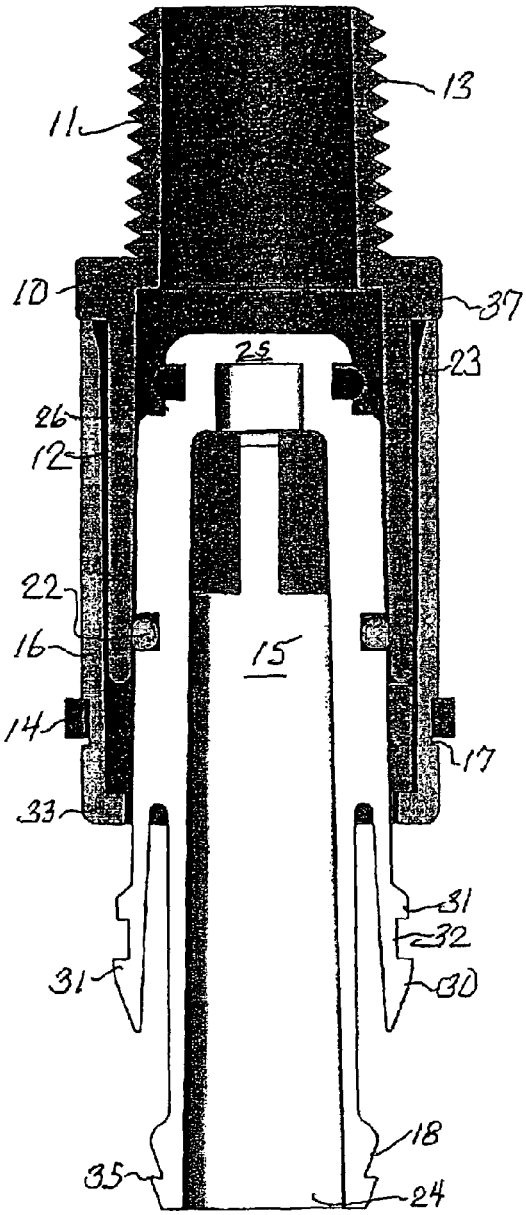
FIG. 4 is a view showing the sealing barrel of the drain valve assembly arranged spaced away from the lower part of the stem in valve open position (the safety end cap and tether are not shown).

The barrel 15 has at its end adjacent the sleeve 12 of the stem 10 a plug 25 which is adapted to enter the axial passage 13, which together with shoulder 26 on the barrel, blocks the flow of fluid entering the stem passage when the barrel is in its home position as shown in FIG. 3. When it is desired to open the stem passage 13 and its corresponding fluid communication passage, aperture 24, the tabs 30 are pressed together to move the barrel 15 downwardly and open the flow passages, as shown in FIG. 4. Spaced apart on the tabs 30 are a pair of ribs 31 which define a recess 32 for receiving a return 33 at the end of the housing 16, and when the tabs or pinched together, these ribs and recess clear the return and permit the barrel 15 to move downwardly and open the passage, and when the barrel is returned to closed position the ribs and recess snap engage the tabs 30 and hold the barrel closed.

At the remote end of the barrel 15 on its outer circumference there are a series of ring like undulations or barbs 35 which are adapted to engage the interior of the safety end cap 19. This end cap 19 also has a lever 36 which may be manipulated when the end cap is installed over the barrel axial aperture 24 to open the end of the fluid passage. The stem 10 may also have a multi-sided area 37 at the base of the threaded portion 11 which may receive a wrench to securely tighten the threaded portion into a crankcase or similar fluid reservoir.

The barrel 15 is free to horizontally rotate to any degree in the circumference of a circle. This feature makes it possible for a user to open or close the drain valve assembly from any reachable position by merely pinching the tabs together and pulling the barrel to open position or pushing it closed. The feature may also be important to original equipment manufacturers who can install a more versatile drain valve assembly in their equipment without as much concern for other parts which are near the desired drain valve location and which may block its efficient use.

From this disclosure, it is apparent that the improved drain valve assembly shown permits fluid to flow merely by pulling the barrel 15 downwardly or to stop the flow of fluid by pushing the barrel upwardly. No twisting of the barrel is required, although the barrel may be turned on its horizontal axis and the barrel is still functional to move upwardly or downwardly as desired. The surfaces upon which the barrel moves are relatively vertically long, so that the barrel is constantly supported and the flow is open, even if the fluid contains "gunk" or other greasy based solids which could interfere with the fluid flow if the direction of flow was interrupted. By use of the structure taught herein, movement of the sealing barrel in the connected stem and housing may also be used to control the volume and flow of fluid through the fluid passage.

While a preferred embodiment of the invention has been shown and described in considerable detail, it should be understood that many changes can be made in the structure without departing from the spirit or scope of the invention, and it is not desired that the invention should be limited to the exact construction disclosed.

The invention claimed is:

1. A valve assembly adapted for connection in a reservoir for gravity draining of fluid therefrom, said valve assembly comprising:

a hollow tubular stem having connecting means at its one end adapted for insertion into said reservoir, a housing secured to said stem, and a sealing barrel in flow communication with and slidably secured in said stem and housing adapted to close said barrel against a scaling surface, said barrel having a tab extending from said housing which when engaged selectively moves said barrel toward and away from said sealing surface, said tab having a first position closing said stem and barrel to prevent gravity flow of fluid therethrough and having a second position moving said barrel away from said sealing surface to open the gravity flow of fluid through said valve assembly, said barrel being selectively opened or closed by moving said barrel solely in the direction of flow of fluid from said reservoir and in line without twisting;

said tab comprising a flexible lever integral with said barrel substantially enclosed within said housing when said barrel is in said closed first position and substantially free of said housing when in said second open position.

2. In the drain valve assembly recited in claim 1, wherein said tab has lock means for securing said barrel in closed position.

3. In the drain valve assembly recited in claim 2, wherein said lock means comprises a barb adapted to selectively engage said housing when in said closed position.

4. In the drain valve assembly recited in claim 1, wherein said sealing surface is arranged at one end of said barrel opposed to said tab.

5. In the drain valve assembly recited in claim 4, wherein said sealing surface has a plug adapted to close said barrel against said stem.

6. In the drain valve assembly recited in claim 4, wherein said sealing surface has an annular shoulder adapted to bear against said stem.

7. In the drain valve assembly recited in claim 1, wherein said assembly may be partially opened or closed by varying the movement of said barrel against said stem to enlarge or reduce said fluid flow.

8. In the drain valve assembly recited in claim 1, wherein said stem is secured to said housing over said barrel by cooperating rib and aperture means.

9. In the drain valve assembly recited in claim 8, wherein said rib means extends from said housing and said aperture means are arranged in said stem.

10. In the drain valve assembly recited in claim 1, wherein said tab may be manipulated to open and close said fluid flow passage irrespective of the rotational orientation of said barrel in said drain valve assembly.

* * * * *